US006337448B1

(12) United States Patent
Konda

(10) Patent No.: US 6,337,448 B1
(45) Date of Patent: Jan. 8, 2002

(54) CIRCUIT BREAKER

(75) Inventor: Kazumoto Konda, Nagoya (JP)

(73) Assignees: Autonetworks Technologies, LTD, Aichi; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/521,945

(22) Filed: Mar. 9, 2000

(30) Foreign Application Priority Data

Mar. 11, 1999 (JP) ..... 11-065474

(51) Int. Cl.[7] ..... H01H 1/00
(52) U.S. Cl. ..... 200/238; 200/17 R
(58) Field of Search ..... 200/238, 17 R, 200/43.05, 162, 43.01–43.22, 50.01–50.11, 50.19, 243, 537, 554, 561, 455, 401

(56) References Cited

U.S. PATENT DOCUMENTS 4,308,436 A * 12/1981 Sone et al. ..... 200/19 R
4,468,543 A * 8/1984 Sone et al. ..... 200/19 DR
4,625,085 A * 11/1986 Yoshida et al. ..... 200/19 R
5,831,228 A 11/1998 Kuki et al.
5,842,560 A 12/1998 Kuki et al.
5,847,338 A 12/1998 Kuki et al.

FOREIGN PATENT DOCUMENTS

JP 61-210273 * 9/1986
JP 62-258173 * 11/1987

* cited by examiner

*Primary Examiner*—Paula Bradley
*Assistant Examiner*—Nhung Nguyen
(74) *Attorney, Agent, or Firm*—Oliff & Berridge, PLC

(57) ABSTRACT

In a circuit breaker, fixed electrodes 14 in pair are secured in a male housing 13. A female housing 21 which contains a moving electrode 30 is fitted into the male housing 13, whereupon the moving electrode 30 contacts and straddles the fixed electrodes 14 to make a short circuit. The moving electrode 30 comprises in integral combination retainer pieces 32 that are retained in an electrode retainer tube 22 in the female housing 21, a contact lug 31 that either contacts or detaches from the fixed electrodes 14, and a narrow-width joint 33 that joints the retainer pieces 32 and the contact lug 31 to make an integral unit. The narrow-width joint 33 flexes to deform, thereby absorbing the positional offset that develops when the contact lug 31 comes into engagement with the fixed electrodes 14.

4 Claims, 8 Drawing Sheets

CIRCUIT BREAKER

BACKGROUND OF THE INVENTION

1. Field of the Invention

The present invention relates to a circuit breaker that may typically be provided halfway on power cables in an electric vehicle.

2. Description of the Related Art

Certain models of electric vehicles have a circuit breaker provided halfway on power cables so that they can be disconnected if necessary as in maintenance. A prior art example of such circuit breaker is described in Unexamined Published Japanese Patent Application (kokai) No. 223439/1997. As shown in FIG. 10, the circuit breaker which is generally indicated by a comprises a casing b and two cylindrical fixed electrodes c and d erected within the casing b to provide a bipolar structure. One fixed electrode c is connected to a terminal metal plate f pressed against an electric cable e whereas the other fixed electrode d is connected to an end of a fuse i via a bus bar h. The other end of the fuse i is connected to a terminal metal plate g pressed against an electric cable e.

A moving electrode j having a handle o can be brought into or out of engagement with the fixed electrodes c and d. The combination of these electrodes constitutes a breaker switch p which is connected in series with the fuse i between the electric cables. The moving electrode j of the breaker switch p has contacts k and m that establish communication via a communicating portion n. The contacts k and m are brought into or out of engagement with the fixed electrodes c and d to establish or break continuity between the electric cables e.

Electric vehicles today are required to use smaller and lighter parts, among which the circuit breaker a is by no means an exception. A problem with this circuit breaker is that its minimum size is determined by the bipolar structure of the fixed electrodes c and d and the demand for further reduction in size and weight cannot be met.

As another problem, in order to bring the moving electrode j into engagement with the fixed electrodes c and d, the two contacts k and m need have registry with the respective fixed electrodes c and d but this involves a cumbersome operation. If the contacts and the fixed electrodes are installed in positions offset from the exact correspondence, the pressure required to insert the moving electrode j increases, making it difficult to bring this electrode into or out of engagement with the fixed electrodes.

SUMMARY OF THE INVENTION

The present invention has been accomplished under these circumstances and has as an object providing a circuit breaker that is made smaller and lighter and which permits ease in bringing the moving electrode into or out of engagement with the fixed electrodes.

To achieve the above object, according to a first aspect of the invention, there is provided a circuit breaker comprising a pair of fixed electrodes, a moving electrode that is brought into or out of engagement with the fixed electrode pair to connect or disconnect the fixed electrodes, and a housing of the moving electrode that is made of an insulating resin, said moving electrode having in integral combination with retainer pieces that are retained in the housing, a contact lug that either contacts or detaches from the fixed electrodes, and a narrow-width joint that joins the retainer pieces and the contact lug.

According to a second aspect of the invention, the retainer pieces form a tubular shape that surrounds the contact lug.

According to a third aspect of the invention, the contact lug is split in the distal end portion by means of a slit extending from the distal end toward the basal end.

According to a fourth aspect of the invention, the fixed electrodes are each provided with an elastic lug formed by bending the free end in a U shape to be parallel with the direction in which said moving electrode is inserted.

In the first aspect of the invention, the pair of fixed electrodes have a unipolar structure that is created by arranging two electrodes to face each other. Compared to fixed electrodes arranged to have a bipolar structure, the unipolar structure requires a smaller space of installation and a smaller and lighter circuit breaker can be realized. The fixed electrodes of a unipolar structure have the additional advantage of reducing the likelihood for the occurrence of a positional offset between the fixed electrode pair and the moving electrode, thus providing ease in bringing the moving electrode into or out of engagement with the fixed electrodes. As a further advantage, the moving electrode is contained in a housing made of an insulating resin, so safety is assured when bringing it into or out engagement with the fixed electrodes.

Since the moving electrode is contained in the housing, one may suspect that the positioning action of the housing could introduce, rather than eliminate, a positional offset from the fixed electrodes. But this will not happen in the present invention; the contact lug of the moving electrode that contacts the fixed electrode pair and the retainer piece retained in the housing are joined via the narrow-width joint, and upon flexing to deform, the joint absorbs any positional offset to ensure that no galling force will be exerted upon the moving electrode or the fixed electrodes. This provides greater ease in the process of bringing the moving electrode into or out of engagement with the fixed electrodes.

In the second aspect of the invention, since the retainer pieces of the moving electrode are formed in a tubular shape that surrounds the contact lug, there is no possibility for the contact lug to deform by bumping against a foreign object or to be damaged in the manufacturing process at the step of installing the moving electrode on the housing.

In the third aspect of the invention, since the distal end portion of the contact lug of the moving electrode is split into two parts by means of a slit, the moving electrode, when brought into engagement with the fixed electrodes, has better fit to assure stable contact with the latter.

In the fourth aspect of the invention, since the fixed electrodes are each provided with the elastic lug, they can have more stable contact with the contact lug of the moving electrode.

DETAILED DESCRIPTION OF THE PREFERRED EMBODIMENTS

Figure 1:
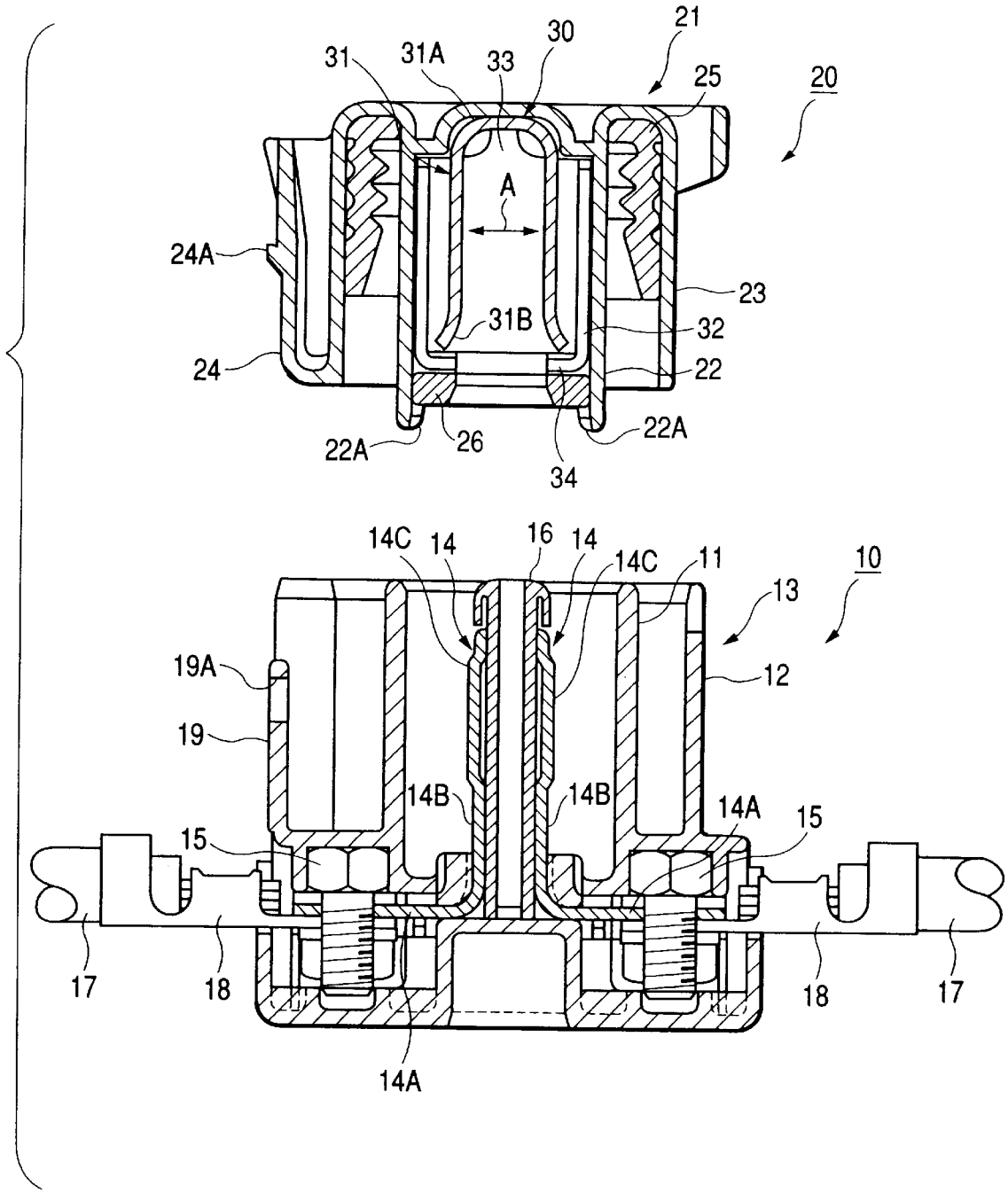
FIG. 1 shows in section the male and female units of a circuit breaker according to the first embodiment of the invention as they are disconnected from each other to open the circuit.

Several embodiments of the invention are described below with reference to accompanying drawings.

<First Embodiment>

The first embodiment of the invention is now described with reference to FIGS. 1–6. This embodiment relates to a circuit breaker provided halfway on power cables in an electric vehicle. The circuit breaker consists of a male unit 10 shown in the lower block of FIG. 1 and a female unit 20 shown in the upper block. We first describe the male unit 10, which comprises an inner tube 11 and an outer tube 12 that are each in the form of a generally rectangular tube and which combine to form a bottomed male housing 13 that has a pair of fixed electrodes 14 secured in its interior. Each fixed electrode 14 is formed by bending a metal plate in a generally L shape. The bottom sides 14A of the fixed electrodes 14 are secured to the bottom of the male housing 13 with bolts 15 and their rising sides 14B are secured to opposite sides of an electrode retainer plate 16 erected as an integral part of the center of the inner tube 11. Each rising side 14B has a contact bead 14C extending vertically.

Each bolt 15 also tightens a terminal metal plate 18 that is clamped to each cable 17 in the power line of an electric vehicle, so that the two cables 17 are interrupted by the two fixed electrodes 14. The left side of the outer tube 12 of the male housing 13 has an engagement wall 19 projecting as an integral part and an engagement hole 19A is formed in this wall.

Figure 2:
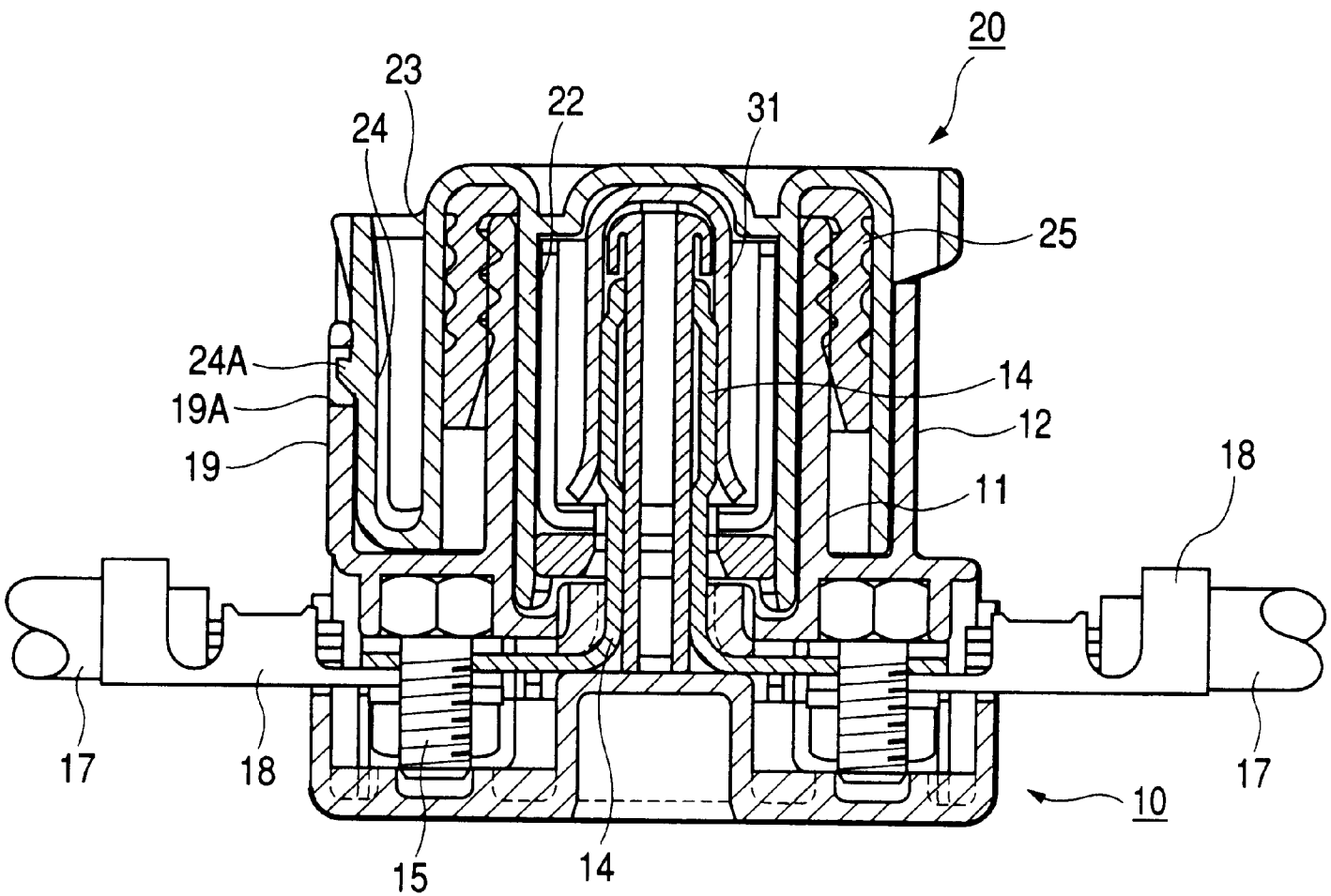
FIG. 2 shows in section the two basic units that are fitted (connected) together to close the circuit.
Figure 3:
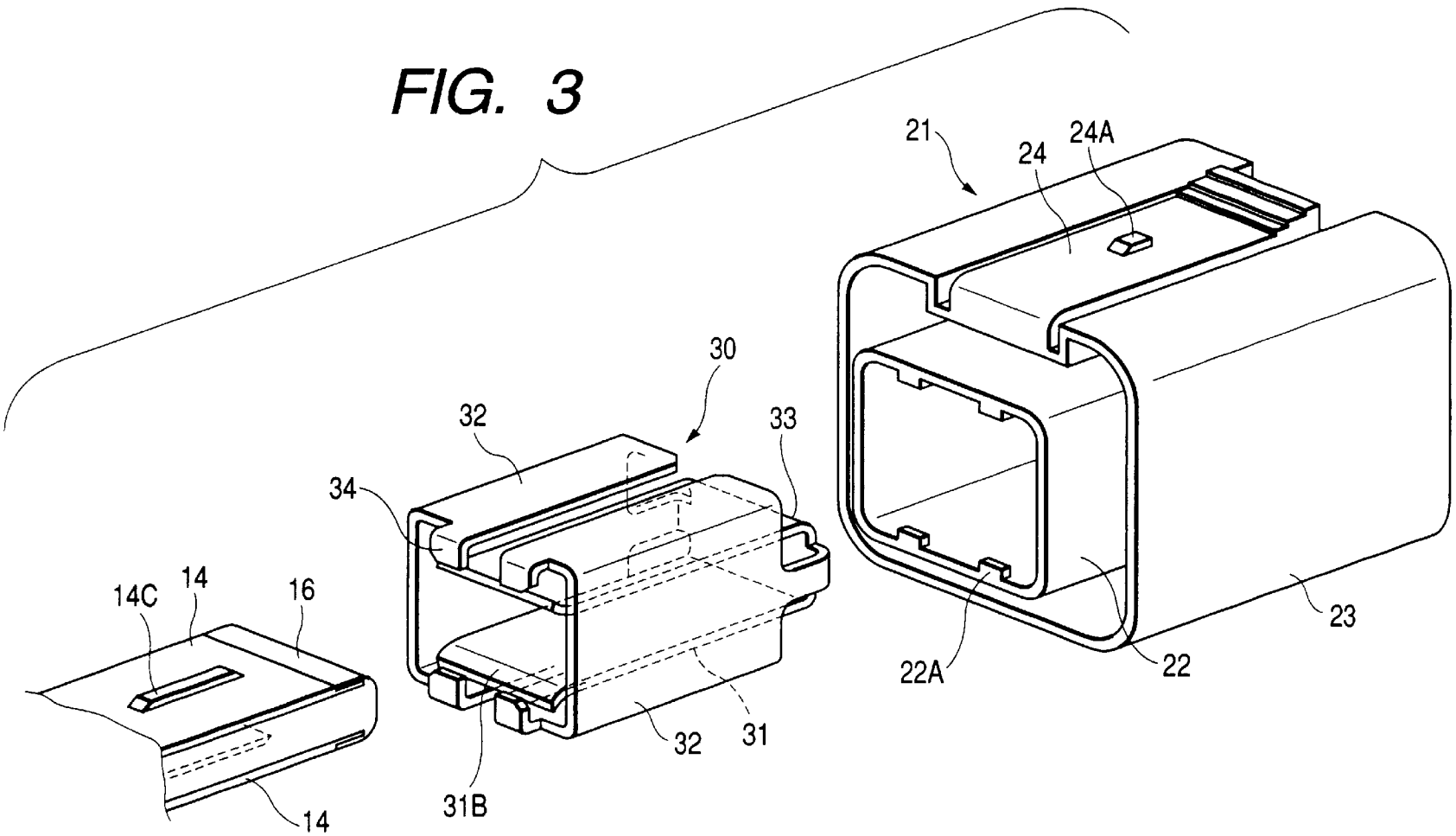
FIG. 3 is a perspective exploded view of the essential parts of the circuit breaker according to the first embodiment of the invention.
Figure 4:
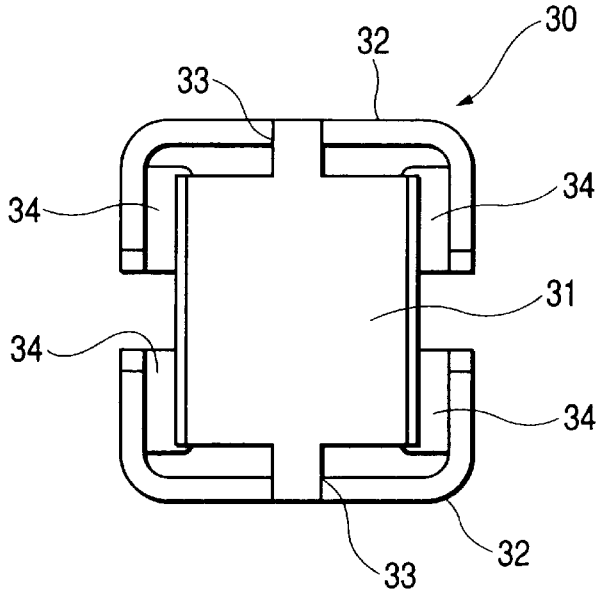
FIG. 4 is a plan view of the moving electrode in the circuit breaker according to the first embodiment of the invention.
Figure 5:
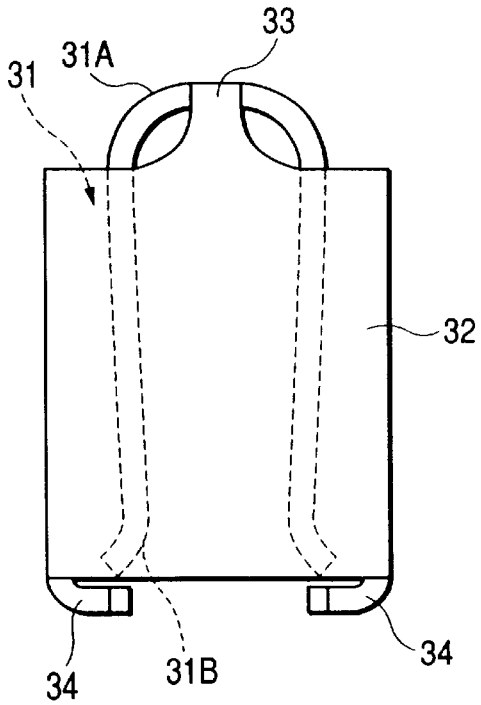
FIG. 5 is a front view of same moving electrode.
Figure 6:
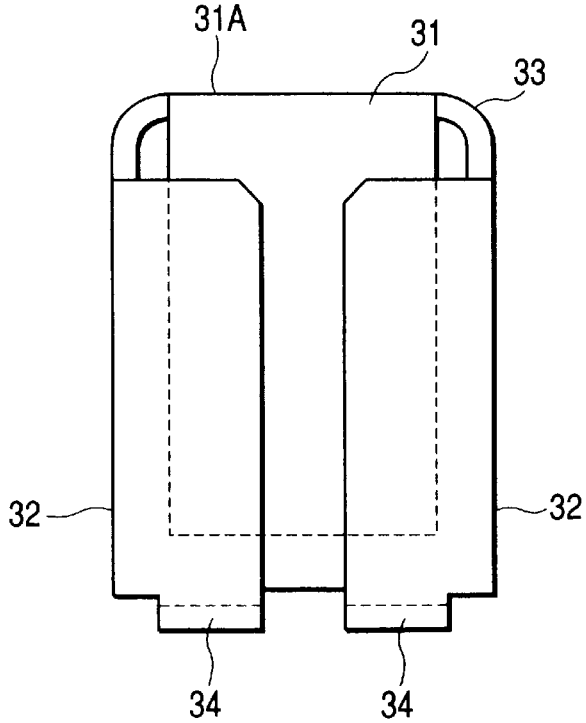
FIG. 6 is a side view of the same moving electrode.

The female unit 20 comprises a female housing 21 and a moving electrode 30 contained in it. The female housing 21 which is molded of an insulating synthetic resin consists of an electrode retainer tube 22 in the form of a rectangular tube that can be fitted into the inner tube 11 of the male housing 13 and an outer tube 23 that can be inserted between the inner tube 11 and the outer tube 12 of the male housing 13. The female housing 21 is in the form of an inverted container, with the two tubes 22 and 23 connected together on the top, and it can be fitted into the male housing 13. The outer tube 23 of the female housing 21 has an elastic engagement lug 24 as an integral part that extends upward from the lower end of the left side. When the two housings 13 and 21 are combined as shown in FIG. 2, an engaging projection 24A of the elastic engagement lug 24 fits into the engagement hole 19A in the male housing 13 so that the female housing 21 will not slip out of the male housing 13. The outer tube 23 of the female housing 21 has an annular waterproof seal 25 fitted therein so that, when the two housings 13 and 21 are combined, the inner peripheral surface of the waterproof seal 25 makes intimate contact with the outer peripheral surface of the inner tube 11 of the male housing 13 to prevent the entrance of water into the inner tube 11.

The electrode retainer tube 22 holds the moving electrode 30 that is prevented from slipping out by means of a retainer 26 which, in turn, is prevented from slipping out by means an engaging projection 22A at the bottom end of the electrode retainer tube 22.

We now describe the moving electrode 30 in detail. This electrode is formed by bending a single metal plate into the shape shown in FIGS. 3–6. As specifically shown in FIG. 5, the moving electrode 30 has a generally U-shaped contact lug 31 that has an upper U-shaped bend 31A which extends downward with the decreasing distance between the two branches to form outwardly curved guides 31B at the bottom ends. The distance between the curved guides 31B is set to be smaller than the thickness of the electrode retainer plate 16 of the male unit 10. The moving electrode 30 also has a pair of retainer pieces 32 in such a position that they cover the contact lug 31 from opposite sides. The retainer pieces 32 each have a U-shaped cross section and, when combined together, they form a rectangular tube that holds the contact lug 31 from opposite sides and which is accommodated within the electrode retainer tube 22 of the female housing 21. The retainer pieces 32 as inserted into the electrode retainer tube 22 do not make intimate contact with the inner surfaces of the latter but leave a slight gap that is large enough to permit some rattling.

The top end of each retainer piece 32 and the U-shaped bend 31A of the contact lug 31 are joined integrally by means of a narrow-width joint 33 such that the contact lug 31 is suspended from above to lie between the retainer pieces 32. The narrow-width joint 33 as it keeps the contact lug 31 suspended is capable of flexing to deform so that the bottom ends of the contact lug 31 swing back and forth in the direction of the two-head arrow A in FIG. 1. Each retainer piece 32 has at its bottom end a contact lug protector 34 that is bent inwardly.

Having the construction described above, the circuit breaker according to the first embodiment of the invention works in the following manner. When the female unit 20 is not fitted in the male unit 10 as shown in FIG. 1, the fixed electrodes 14 are not in contact with each other, so the electric cables 17 are electrically interrupted.

When the female unit 20 is pushed into the male unit 10, the electrode retainer tube 22 of the female unit 20 is first inserted into the inner tube 11 of the male housing 13 and as it is guided by the inner peripheral surface of the inner tube 11, the fitting of the female unit 20 proceeds until the contact lug 31 of the moving electrode 30 contacts and straddles the two fixed electrodes 14, thereby establishing continuity between those fixed electrodes (see FIG. 2).

In the fitting process described above, the housing 13 of the male unit 10 and the housing 21 of the female unit 20 are fitted into each other to produce a positioning effect and the moving electrode 30 contacts and straddles the fixed electrodes 14 in the positions that are determined by this positioning effect. The fixed electrodes 14 are secured in the male housing 13 and the moving electrode 30 is provided in the female housing 21, so theoretically the two groups of electrodes 14 and 30 should contact each other in appropriate relative positions. In practice, however, various errors such as electrode bending errors, housing molding errors and electrode installation errors are unavoidable and even if the positioning effect of the housings 13 and 21 enables themselves to be fitted in the normal positions, the two groups of electrodes 14 and 30 may occasionally be offset from each other. If this occurs, the electrodes 14 and 30 might begin to contact either obliquely or in an offset condition in the process of fitting of the housings 13 and 21.

In the embodiment under consideration, the contact lug 31 of the moving electrode 30 is joined to each retainer piece 32 via the narrow-width joint 33. Therefore, even if the retainer pieces 32 are positioned with respect to the male housing 13 as if they were an integral part of the female housing 21, the narrow-width joint 33 flexes to deform as the contact lug 31 is fitted into the male housing 13 until it straddles the fixed electrodes 14; as a result, any offset between the two groups of electrodes 14 and 30 is effectively absorbed and those electrodes smoothly reach the final fitting positions without producing any unstrained galling forces. What is more, the retainer pieces 32 of the moving electrode 30 can rattle to some extent within the electrode retainer tube 22 of the female housing 21 and this rattling is also effective to absorb positioning errors. As a result, the female unit 20 (moving electrode 30) can be brought into and out of engagement with the male unit 10 (fixed electrodes 14) in a very simple manner.

Needless to say, the pair of fixed electrodes 14 have a unipolar structure that is created by arranging two electrodes to face each other. Compared to the prior art circuit breaker in which fixed electrodes are arranged to have a bipolar structure, the unipolar structure requires a smaller space of installation and a smaller and lighter circuit breaker can be accomplished. As a further advantage, the moving electrode 30 is contained in the female housing 21 made of an insulating resin, so safety is assured when bringing it into or out engagement with the fixed electrodes 14. What is more, in the first embodiment under consideration, the retainer pieces 32 of the moving electrode 30 form a tubular shape that surrounds the contact lug 31, so there is no possibility for the contact lug 31 to deform by bumping against a foreign object or to be damaged in the process of circuit breaker manufacture at the step of installing the moving electrode 30 on the female housing 21.

<Second Embodiment>

Figure 7:
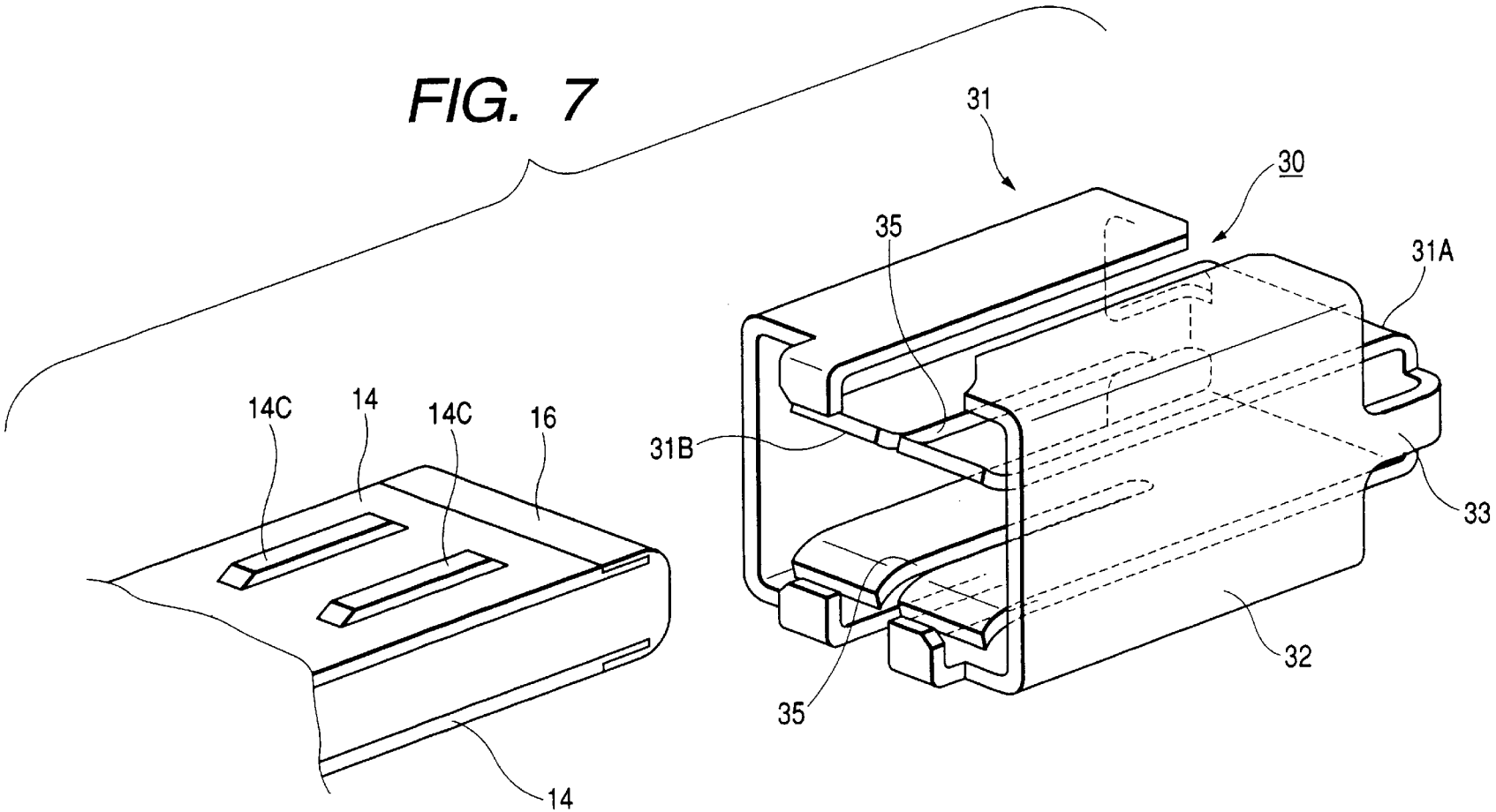
FIG. 7 is a perspective exploded view of the essential parts of a circuit breaker according to the second embodiment of the invention.

FIG. 7 shows the second embodiment of the invention. It has two differences from the first embodiment: first, the contact lug 31 of the moving electrode 30 has a slit 35 that extends from the distal end toward the basal end to split the distal end portion into two parts; second, two contact beads 14C are correspondingly formed on each fixed electrode 14. The other features of the second embodiment are essentially the same as the first embodiment and need not be described in detail.

In this design, the split parts of the contact plug 31 respectively contact the two contact beads 14C to provide more positive contact between the two groups of electrodes.

<Third Embodiment>

Figure 8:
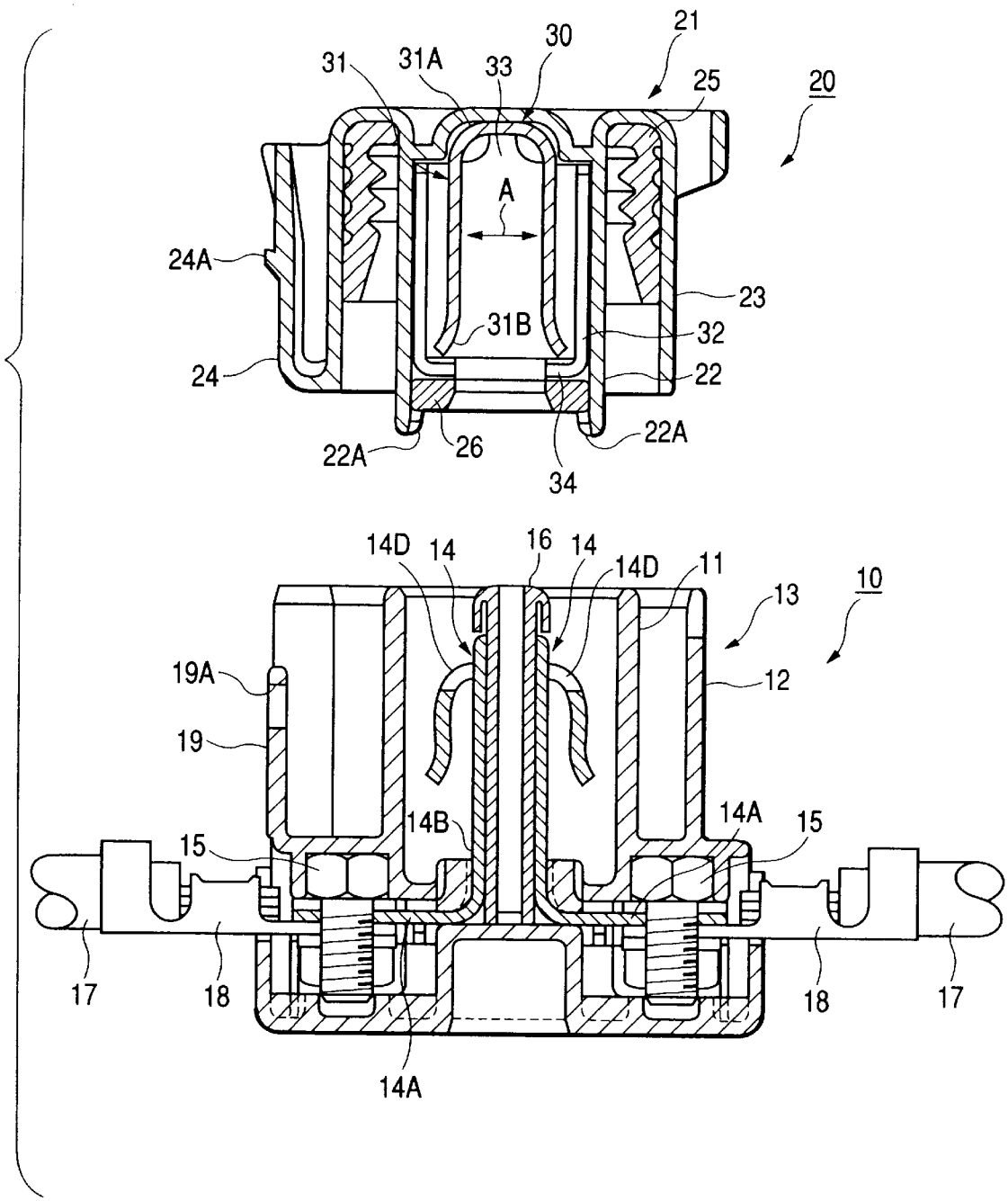
FIG. 8 is a sectional view of a circuit breaker according to the third embodiment of the invention.
Figure 9:
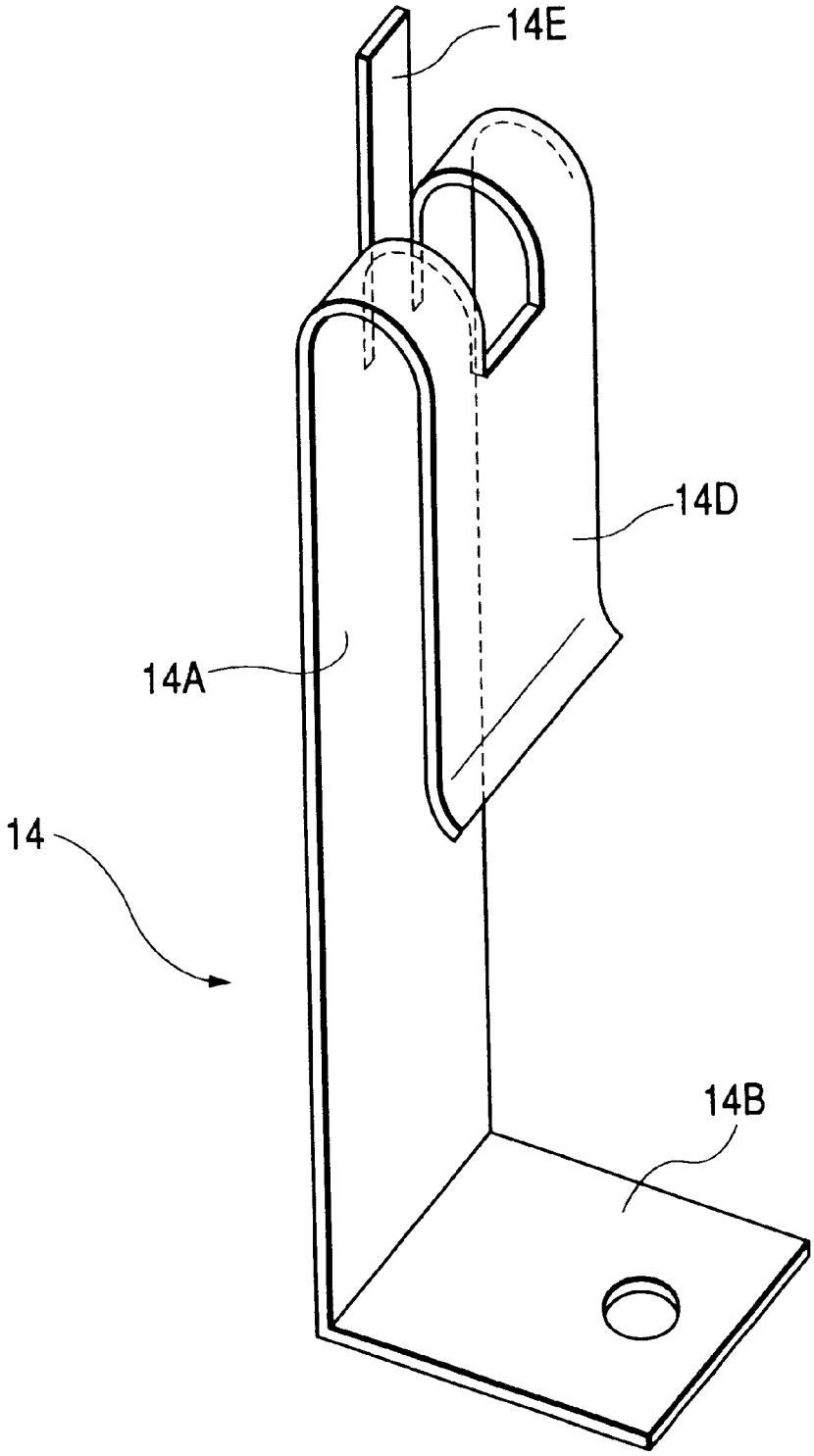
FIG. 9 is a perspective view of one of the fixed electrodes in pair used in the circuit breaker according to the third embodiment of the invention.
Figure 10:
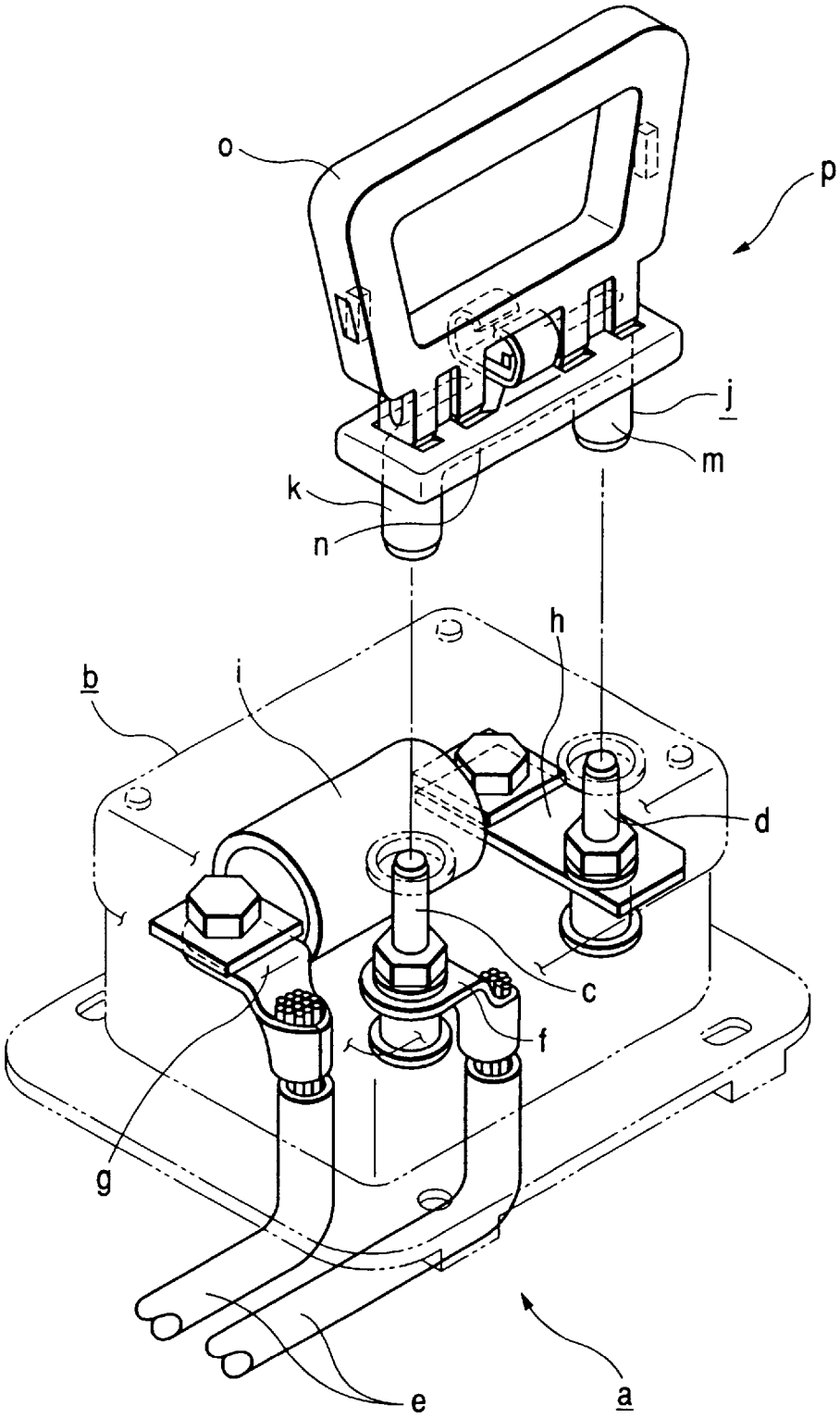
FIG. 10 (PRIOR ART)
FIG. 10 is a perspective view of a prior art circuit breaker.

FIGS. 8 and 9 show the third embodiment of the invention. It also has two differences from the first embodiment: first, the rising side 14A of each fixed electrode 14 has an elastic lug 14D formed by bending its free end downward in a U shape; second, the rising side 14A has an engaging lug 14E that projects from its top end to come into engagement with the upper part of the electrode retainer plate 16 of the male housing 13. The other features of the third embodiment are essentially the same as the first embodiment and need not be described in detail.

With this design, the elastic lug 14D of each fixed electrode 14 also helps produce a resilient force at the point of contact with the moving electrode 30 and even if no contact beads are provided on the fixed electrodes 14, they can have contact with the moving electrode across the entire surface of the contact lug 31. As a result, the two groups of electrodes can have more reliable contact while reducing the contact resistance.

<Other Embodiments>

The present invention is by no means limited to the embodiments described with reference to the foregoing disclosure and attached drawings. The following embodiments are also feasible and included within the technical scope of the invention.

(1) In each of the embodiments described above, the fixed electrodes are of a bipolar type but they may be of a tripolar type in which they are provided within three regions of a circle that are spaced apart by an angle of 120 degrees, with one fixed electrode being in a face-to-face relationship with two adjacent fixed electrodes such that two fixed electrodes make a pair with respect to a common fixed electrode.

(2) In each of the embodiments described above, the circuit breaker is designed to have only a switching capability but it may be so designed that a fuse connected to the fixed electrodes is incorporated in the male unit.

(3) In each of the embodiments described above, the fixed electrode pair is on the male side and the moving electrode is on the female side which is fitted into the male side. The concept of the invention is also applicable if the fixed electrode pair is one the female side and the moving electrode is on the male side.

(4) If the fixed electrode pair is on the male side, the shape of the individual fixed electrodes is not limited to a cylinder and it may be a prism. Even non-columnar shapes are also included in the scope of the invention.

What is claimed is:

1. A circuit breaker comprising:

a pair of fixed electrodes;

a moving electrode that is brought into or out of engagement with said fixed electrode pair to connect or disconnect said fixed electrodes; and a housing of said moving electrode that is made of an insulating resin, said moving electrode having in integral combination retainer pieces that are retained in said housing, a contact lug that either contacts or detaches from said fixed electrodes; and a narrow-width joint that joins said retainer pieces and said contact lug.

2. The circuit breaker according to claim 1, wherein said retainer pieces form a tubular shape that surrounds said contact lug.

3. The circuit breaker according to claim 1, wherein said contact lug has a distal end portion and a base end, the distal end portion being split by means of a slit extending from the distal end toward the basal end.

4. The circuit breaker according to claim 1, wherein said fixed electrodes are each provided with an elastic lug formed by bending a free end of the elastic lug in a U shape to be parallel with the direction in which said moving electrode is inserted.

* * * * *